US006857806B2

(12) United States Patent
Harrison et al.

(10) Patent No.: US 6,857,806 B2
(45) Date of Patent: Feb. 22, 2005

(54) DISPENSERS FOR LIQUIDS

(75) Inventors: Paul Harrison, Derbyshire (GB); Simon Buckley, Lancashire (GB)

(73) Assignee: Rieke Packaging Systems Limited, Leicestershire (GB)

( * ) Notice: Subject to any disclaimer, the term of this patent is extended or adjusted under 35 U.S.C. 154(b) by 0 days.

(21) Appl. No.: 10/451,515

(22) PCT Filed: Dec. 24, 2001

(86) PCT No.: PCT/GB01/05765

§ 371 (c)(1),
(2), (4) Date: Dec. 15, 2003

(87) PCT Pub. No.: WO02/051283

PCT Pub. Date: Jul. 4, 2002

(65) Prior Publication Data

US 2004/0091303 A1 May 13, 2004

(30) Foreign Application Priority Data

Dec. 22, 2000 (GB) ..... 0031565

(51) Int. Cl.[7] ..... B43M 11/02

(52) U.S. Cl. ..... 401/219; 401/208

(58) Field of Search ..... 401/6, 208, 209, 401/216, 219, 280, 281

(56) References Cited

U.S. PATENT DOCUMENTS

| | | | | | |
|---|---|---|---|---|---|
| 669,973 | A | * | 3/1901 | Samson et al. | 33/23.01 |
| 4,723,860 | A | * | 2/1988 | Giblin et al. | 401/208 |
| 5,213,431 | A | * | 5/1993 | Gentile et al. | 401/219 |
| 5,308,182 | A | * | 5/1994 | Lampert | 401/219 |

* cited by examiner

*Primary Examiner*—David J. Walczak
(74) *Attorney, Agent, or Firm*—Fay, Sharpe, Fagan, Minnich & McKee, LLP

(57) ABSTRACT

A roller dispenser for dispensing liquids has a headpiece mounted on a container. A barrier component is fitted between the headpiece and the container. The barrier component and the headpiece have respective annular seal elements which can fit together to form a plug seal, isolating the underside of the roller from the liquid supply when the barrier and headpiece are moved close together. The barrier and headpiece can be moved apart by a cam action, e.g., a thread, in order to allow liquid onto the roller.

10 Claims, 2 Drawing Sheets

DISPENSERS FOR LIQUIDS

FIELD OF THE INVENTION

This invention has to do with dispensers which apply a liquid from a container onto a surface, e.g. the skin, via a roller.

BACKGROUND

Roller applicators are well-known as such, and conventionally consist of a headpiece which screws or snaps onto the container neck. The headpiece has a part-spherical socket surface in which a plastic ball seats. The bottom and top of the ball are exposed to the liquid in the container and to the exterior respectively. In use the top of the ball is held against the skin and rolled on the skin by pulling the dispenser sideways. Liquid wetting the rear of the ball is then progressively applied to the skin from the front of the ball. The ball needs to be a reasonably close but not tight fit in its headpiece socket, so that on the one hand it can roll freely and liquid on its surface can pass through, but on the other hand the flow of liquid is limited.

There can be an issue of leakage or evaporation from the roller applicator. It is routine to provide a snap or screw cover cap to cover the headpiece and exposed ball surface when the applicator is not being used. However liquid may still leak or evaporate into the space between ball and cap and hence be wasted. With highly volatile or penetrating liquids this can be a serious problem.

It has been proposed to prevent such leakage by arranging to clamp the ball down into its headpiece socket when the dispenser is not in use. However extreme precision is needed to get an effective seal between the ball and socket surfaces, and in practice this is not achieved. It has been proposed to include an O-ring to help the seal, but these O-rings are subject to rapid wear and sealing is still poor.

It would be desirable to provide some new way of addressing the problems of leakage and/or evaporation of liquid in such a dispenser.

THE INVENTION

What we propose, in the context of a device for dispensing liquids comprising a container to hold the liquid and a headpiece on the container having a roller seating in which an applicator roller is retained rotatably with its front surface exposed for applying liquid and its rear surface exposed to a liquid pick-up region, is as follows. A barrier is provided between the container interior and the headpiece, and has one or more flow openings. The barrier and headpiece are movable relative to one another between an open position, in which the one or more flow openings of the barrier communicate(s) with the liquid pick-up region, and a closed position in which the headpiece and barrier engage one another making an internal seal which blocks such communication.

The relative movement between the open and closed positions is preferably in an axial direction of the dispenser, typically corresponding to the front-to-rear axis of the roller and/or the axis of the container mouth. Naturally the most usual situation has a cylindrical container coaxial with its dispenser roller. It is preferred that the barrier and headpiece are rotatable relative to one another around that axis, and make a cam engagement so that the rotation drives the axial movement necessary for transition between the open and closed positions. They may for example make a bayonet or thread engagement. Preferably there are rotational limit stops so that the user apprehends the operation as a rotational one between defined rotational limit positions for the open and closed states.

Preferably the barrier is a discrete element secured to the mouth of the container. It is preferred that the barrier is fixed relative to the container and the headpiece movable relative to the container. Whichever of the elements is movable relative to the container preferably has an exposed friction surface e.g. ribs or knurling to help grip it.

The idea is to create a seal between the barrier and headpiece components upstream of where liquid for pick-up contacts the roller. The preferred form of seal is a plug seal in which an axially-extending sealing surface on a seal component of one of the headpiece and barrier engages slidably with an axially-extending sealing surface on a sealing portion of the other, to achieve the closed position. By having the vector of relative movement parallel to the sealing surfaces, or at a small angle (less than 45°, preferably less than 30°) to one or both of them combined with the possibility of one or both of the sealing portions deforming as they move into sealing engagement, an effective seal can be obtained using modest forces and components which are easy to make e.g. by moulding conventional non-elastomeric materials such as polypropylene.

Preferably these respective sealing portions move axially into and out of the sealing relation. However as is an alternative they might be rotatable between the two conditions e.g. by providing one or more circumferentially-localised windows which can be brought into or out of register with one another by relative rotation.

Preferably the sealing portions are both annular, one fitting inside the other. Such an annular seal can divide a space behind the roller into inner and outer zones, one communicating with the flow openings of the barrier and isolated from the liquid pick-up region, the other communicating with (or being) the liquid pick-up region and isolated from the container interior by a closed part of the barrier.

One of the sealing portions is preferably in the form of a projecting wall or skirt, which is to some extent laterally deformable and has the mentioned zones to either side of it. For an annular seal, preferably at least that seal portion which engages outside the other one is a skirt of this kind which is put under tension by interference with the other portion when they seal together. The other portion may be a second skirt or —preferably, from the point of view of simplicity of manufacture—a simple closed boss, plug or recessed wall which is essentially non-flexing on sealing.

A preferred embodiment has the barrier with a closed central zone projecting forwardly as a boss having a peripheral radially-outwardly directed annular sealing surface, and an annular peripheral zone having one or more flow openings. The headpiece has a central cavity which provides the pick-up region i.e. is directly exposed to the rear surface of the roller, and a downwardly projecting skirt seal which, by any manner of axial relative movement as mentioned above, can have its inner sealing surface moved into and out of sealing engagement with the annular sealing surface of the barrier's central boss.

The reader will appreciate that for both the closed and open positions of the internal seal, liquid on the side of the internal seal opposite from the pick-up region needs to be prevented from escaping to the exterior from between the relatively movable barrier and the headpiece. This external seal can be provided by a sliding seal engagement which maintains its closed, sealed condition in both the open and closed conditions of the internal seal. Preferably an annular, axially-slidable seal engagement between the components is provided inwardly of cam engagements between the two, so that the latter are not wetted. A particularly preferred form—again, in that it can be easy to make and can obviate the use of discrete elastomeric seal elements and so forth—is an outer annular plug seal. Like the internal plug seal, this can be formed by respective axially-extending surfaces integral with the headpiece and barrier components. The difference is that the outer plug seal is made with a longer reach so that it remains closed in both the closed and open positions of the interior seal. Preferably one of the two components has an axially-projecting flexible skirt as the seal portion for this outer seal, wiping a substantially cylindrical sealing surface on the other component.

An embodiment of the invention is now described by way of example, with reference to the accompanying drawings.

DETAILED DESCRIPTION OF THE PREFERRED EMBODIMENT

Figure 1:
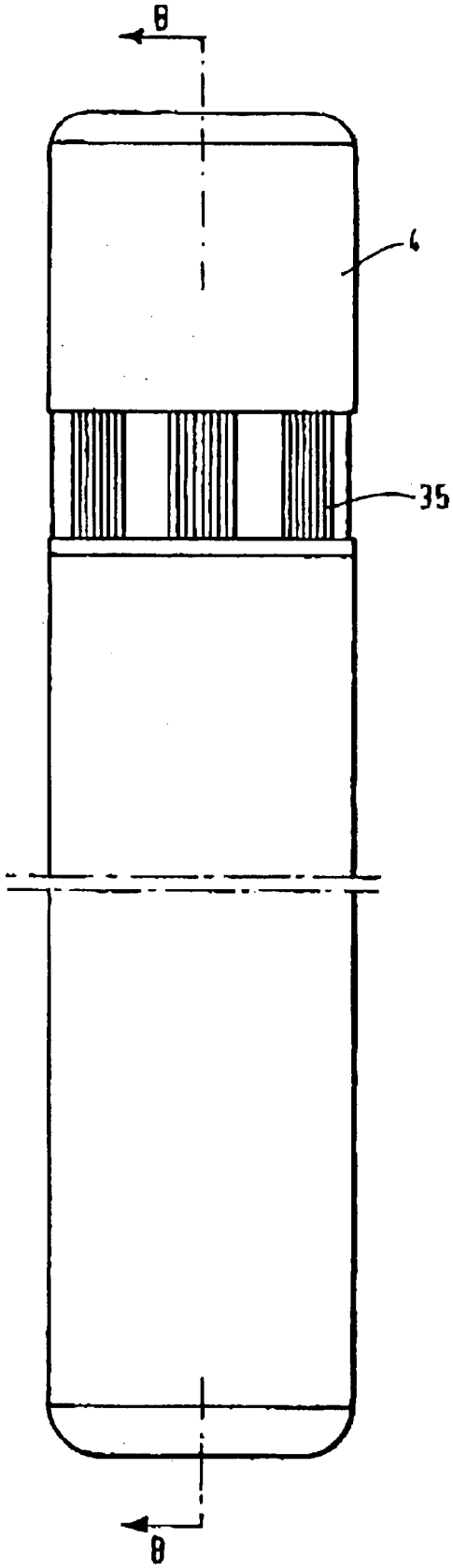
FIG. 1 is a side view of a roller dispenser.

With reference to the figures, a roller applicator is provided on a cylindrical container 1. The container and other components are all of polypropylene. A barrier closure 2 is fixed into the mouth of the container 1 and located axially by means of a plug 25 with snap ribs and a locating flange 26. Above the container mouth the closure 2 continues with an upward cylindrical extension 28, closed over at the top by a barrier web 21.

The barrier web 21 is essentially a flat disc with a raised circular boss 22 in its centre and a relatively recessed annular outer zone around this. A series of flow openings 24 is provided through this outer zone. The periphery of the boss constitutes a sealing surface 23 which is also a transition down to the outer zone. This sealing surface has a slight convergence e.g. at from 10° to 20° to the axis.

Radially outwardly of the openings 24 the upper surface of the web 21 has an integrally-moulded outer sealing skirt 290. This is a cylindrical component, sufficiently thin to be readily flexed and curved near its edge to provide an outwardly-directed sealing land 291.

Figure 3:
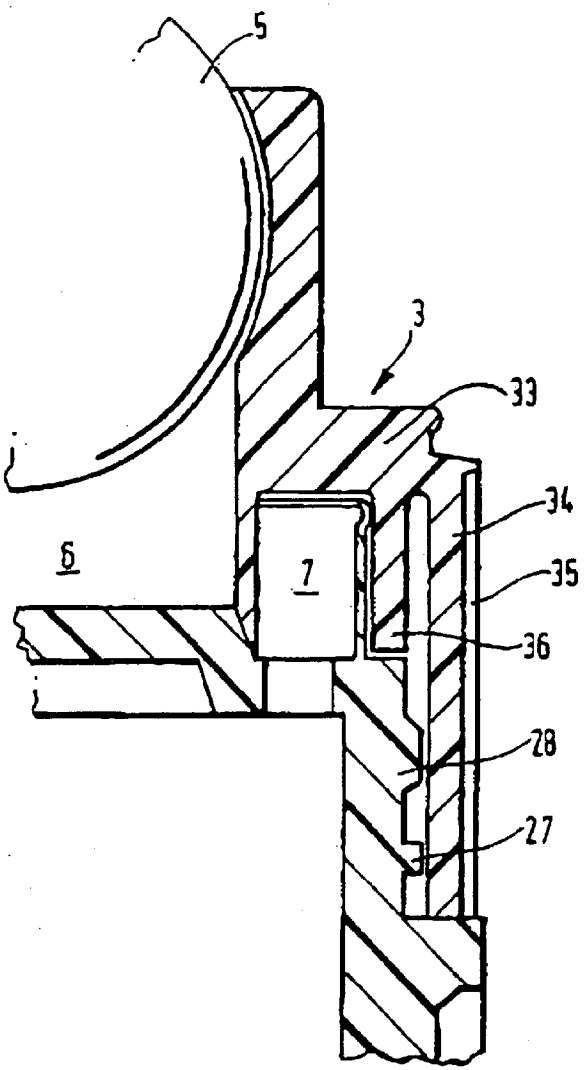
FIG. 3 is an enlarged detail of the axial section, showing a barrier and headpiece in closed position.

The upper extension 28 of the closure 2 has a four-start helical thread 27 moulded on its outer surface. A generally tubular headpiece 3 is fitted over the closure barrier 2. The headpiece 3 has an upper tubular socket extension 32 with a spherical surface region 31 in which a ball 5 is retained rotatably. The ball is snapped into this spherical recess during assembly. Below the socket extension 32 the headpiece 3 has a radially-outwardly projecting web 33 from which three concentric skirts depend. These are a relatively thin and flexible inner sealing skirt 37, radially aligned above the sealing surface 23 of the closure 2, a relatively thick and rigid outer sealing skirt 36 which is the same axial length as the inner sealing skirt 37, and presents a cylindrical inwardly-directed surface aligned to make an interference fit with the flexible seal 290, 291 of the closure barrier, and a longer outer securing skirt 34 which extends down around the outside of the tubular extension 28 of the closure 2. This outer securing skirt 34 has an outer surface with friction ribs 35 and an inner surface with inwardly-directed cam lugs (not shown) which engage in the threads 27 on the closure 2. These threads are blind quarter-turn threads; the headpiece 3 is forcibly snapped into place over the closure sleeve 28 on assembly, whereafter it is held in place and can be rotated only a quarter of a turn. The threads and lugs cooperate so that this quarter turn shifts the headpiece 3 axially between the two positions shown in FIGS. 3 and 4.

The inner sealing skirt 37 of the headpiece 3 has on its inner surface a tapering lead portion 38 which acts as a sealing surface complementing the tapered sealing surface 23 below. The components are dimensioned so that with the thread tightened down (FIG. 3) the sealing boss 22, 23 fits tightly into the tapered skirt opening 38 above and with some interference, so that the skirt edge is under tension and makes a good seal. The corresponding part of the thread 27 may be ramped more gently giving a higher mechanical advantage to bring the seal to this tensioned condition and keep it there.

In this position (FIG. 3) the space beneath the headpiece 3 is sealingly divided by the annular skirt 37 and its engagement with the sealing surface 23 beneath, separating an antechamber 7 (between the inner and outer sealing skirts 37, 36 of the headpiece) from the pick-up region 6 below the ball 5. Because the boss 22 has a closed top, the pick-up region 6 is completely isolated from the container interior. At the same time an external seal is provided by engagement of the sealing land 291 of the barrier's outer sealing skirt 290 with the inner cylindrical surface of the headpiece outer sealing skirt 36. This prevents liquid from escaping to the outside via the antechamber 7.

The tightening movement is limited, to avoid damaging the delicate sealing skirt edges 38, 291 by over-compression. This may be by appropriate positioning of the thread blinds, by abutment of the end of the short rigid sealing skirt 36 or of the long rigid securing skirt 34 with the opposing surface of the closure 2, or a combination of these.

Figure 4:
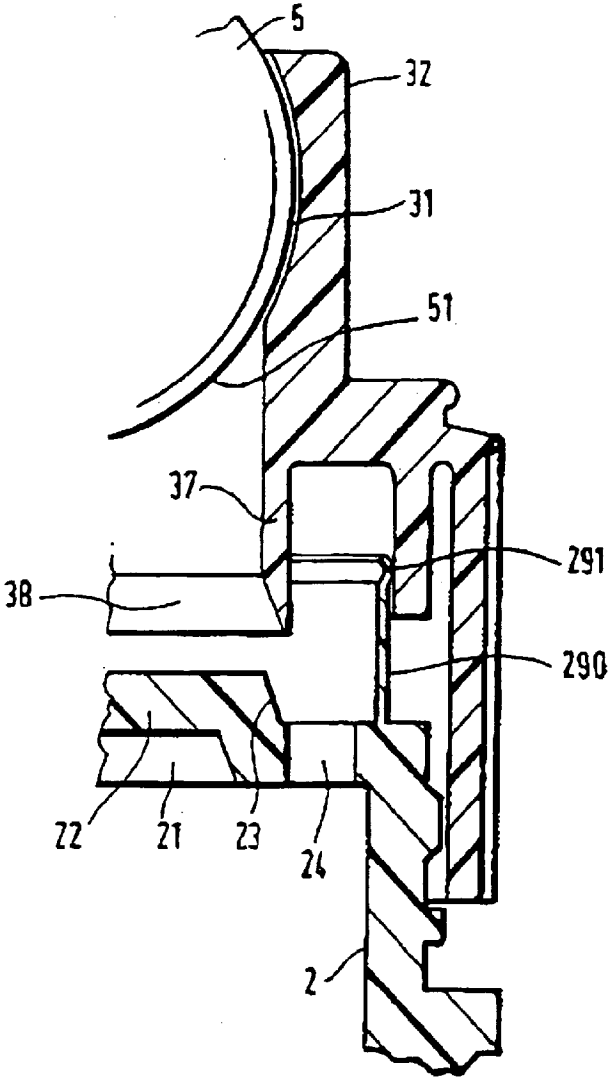
FIG. 4 is a corresponding enlarged view showing the same components in an open position.

Unscrewing the headpiece 3 through a quarter turn shifts it axially to the FIG. 4 position. Here the headpiece inner sealing skirt 37, 38 slides clear of boss 22 beneath, opening up communication from the container interior to the backside 51 of the ball 5. However the upward outer sealing skirt 290, with its longer reach, remains in sealing contact with the inward cylindrical sealing surface of the rigid downward skirt 36 on the headpiece, preventing leakage of liquid to the outside.

After use, a quarter turn of retightening returns to the sealed condition. The tapering of the opposed inner sealing surfaces 23,38 guides their meeting to avoid damage, and also by a sliding camming action tensions the outer seal annulus.

Figure 2:
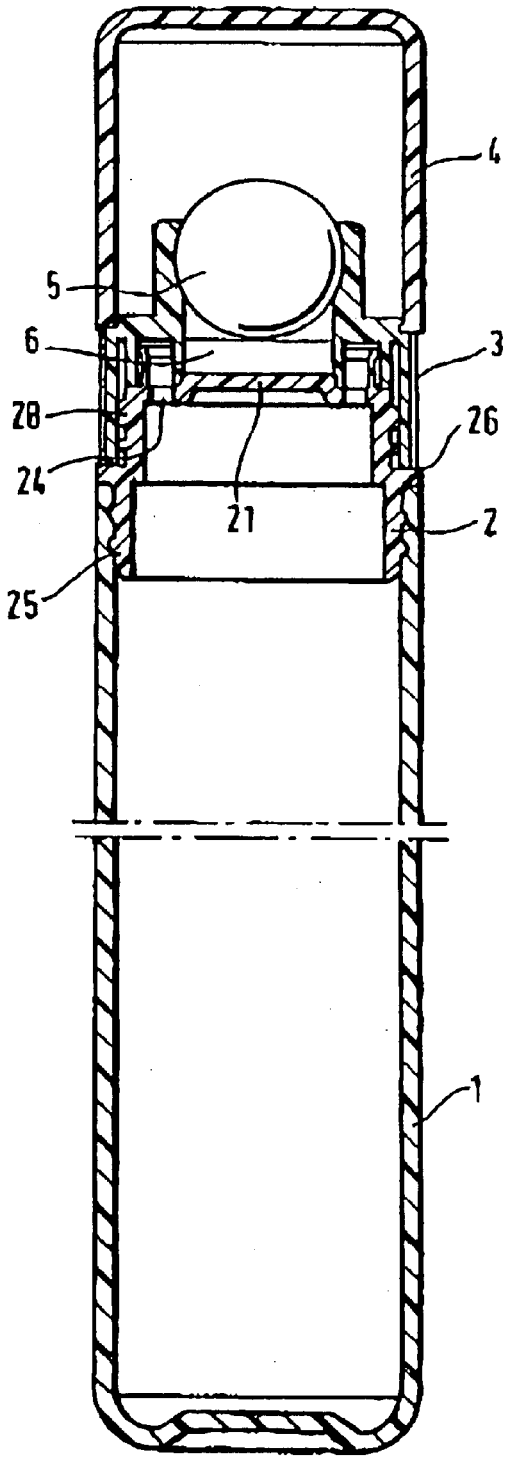
FIG. 2 is an axial section at B—B of FIG. 1.

FIGS. 1, 2 also show a conventional cover cap 4 which can snap onto the headpiece.

What is claimed is:

1. A device for dispensing liquids comprising a container (1) to hold the liquid and a headpiece (3) on the container having a roller seating (31) in which an applicator roller (5) is retained rotatably, with a front surface thereof exposed for applying liquid and a rear surface thereof exposed to a liquid pick-up region (6), characterised in that a barrier (2) is provided between the interior of the container (1) and the headpiece (3), the barrier having one or more flow openings (24) and the barrier and headpiece being movable relative to one another between an open position, in which the one or more flow openings (24) of the barrier communicate(s) with the liquid pick-up region (6), and a closed position in which the headpiece and barrier engage one another making an internal seal which blocks such communication, said relative movement between the barrier (2) and the headpiece (3) being in an axial direction of the dispenser and in which the barrier and headpiece are rotatable relative to one another around the axis, to drive said relative axial movement between them by means of a cam engagement.

2. A device according to claim 1 in which an axially-extending sealing portion on one of the headpiece and barrier is engageable slidably with an axially-extending sealing portion on the other, to form said internal seal as a plug seal in the closed position.

3. A device according to claim 2 in which said sealing portions are both annular, one fitting inside the other.

4. A device according to claim 3 in which one of said annular sealing portions making said internal seal is an interference fit inside the other when they seal together.

5. A device according to claim 3 in which the liquid pick-up region is inside the annular sealing portions and said one or more flow openings of the barrier communicate from the container to an annular peripheral region radially outside the annular sealing portions forming the internal seal, and wherein portions of the barrier and headpiece engage to make a further, external seal to prevent escape of liquid to the exterior from said annular peripheral region.

6. A device according to claim 5 in which the further external seal is an annular plug seal, the headpiece and barrier comprising respective axially-extending relatively rotatable sealing surfaces which engage one another sealingly to provide said plug seal, and which maintain sealing engagement in both the open and closed positions of the internal seal.

7. A device according to claim 1 in which the cam engagement is a threaded engagement between the barrier and the headpiece.

8. A device according to claim 1 comprising rotational limit stops defining limits to said relative rotation between the barrier and headpiece, said limits corresponding to the open and closed positions.

9. A device according to claim 1 in which the barrier is a discrete element fixed relative to the mouth of the container.

10. A device according to claim 9 in which the barrier has a closed central zone, comprising a forwardly-projecting boss, said boss having a peripheral radially-outwardly directed annular sealing surface, the boss also having an annular peripheral zone having said one or more flow openings, and in which the headpiece has a central cavity defining the liquid pick-up region and a downwardly-projecting skirt seal around the liquid pick-up region, the downwardly-projecting skirt seal having an inner sealing surface movable by said axial movement into and out of sealing engagement with the annular sealing surface of the boss to constitute said internal seal.

* * * * *